US008322177B2

(12) United States Patent
Meier et al.

(10) Patent No.: US 8,322,177 B2
(45) Date of Patent: Dec. 4, 2012

(54) METHOD FOR THE PRODUCTION OF METAL CLOSURES

(75) Inventors: Robert Meier, Bad Gandersheim (DE); Frank Roland Strebe, Seesen/Niedersachsen (DE)

(73) Assignee: Crown Packaging Technology, Inc., Alsip, IL (US)

( * ) Notice: Subject to any disclaimer, the term of this patent is extended or adjusted under 35 U.S.C. 154(b) by 809 days.

(21) Appl. No.: 11/910,037

(22) PCT Filed: Mar. 31, 2006

(86) PCT No.: PCT/EP2006/061253

§ 371 (c)(1), (2), (4) Date: Mar. 19, 2008

(87) PCT Pub. No.: WO2006/103293

PCT Pub. Date: Oct. 5, 2006

(65) Prior Publication Data

US 2008/0181749 A1 Jul. 31, 2008

(30) Foreign Application Priority Data

Apr. 1, 2005 (EP) ..... 05102610

(51) Int. Cl.

| | |
|---|---|
| ***B21D 51/26*** | (2006.01) |
| ***B21D 11/10*** | (2006.01) |
| ***B21D 51/44*** | (2006.01) |
| ***B21H 3/06*** | (2006.01) |

(52) U.S. Cl. ..... 72/94; 72/92; 72/379.4; 413/8

(58) Field of Classification Search ..... 72/88, 90, 72/94, 348, 379.4, 68, 84, 91–93; 408/88; 413/8, 11, 24, 56

See application file for complete search history.

(56) References Cited

U.S. PATENT DOCUMENTS

| | | | | |
|---|---|---|---|---|
| 1,348,650 | A * | 8/1920 | Kronquest et al. | 413/30 |
| 2,101,309 | A | 12/1937 | Burns | |
| 2,348,464 | A * | 5/1944 | Bernard | 72/356 |
| 4,655,677 | A | 4/1987 | Lenhart | |
| 6,382,882 | B1 * | 5/2002 | Ouellette | 406/198 |
| 2006/0283228 | A1 * | 12/2006 | Warmbrunn | 72/348 |

FOREIGN PATENT DOCUMENTS

| | | | |
|---|---|---|---|
| WO | 02/49787 | A1 | 6/2002 |
| WO | 2005/023451 | A1 | 3/2005 |

* cited by examiner

*Primary Examiner* — Dana Ross
*Assistant Examiner* — Mohammad I Yusuf
(74) *Attorney, Agent, or Firm* — Woodcock Washburn LLP

(57) ABSTRACT

The present invention relates to a method and tooling suitable for handling closure blanks (5) having an external radius (6) at their cut edge at production speeds of about (1200) closures per minute. The external radius (6) limits formation of "angel hair" (a common problem in metal closure production). However, reversing the external radius causes a problem, when producing metal closures having a conventional inward curl at their peripheral edge. Accordingly, the invention proposes a modified curling rail (40) having a first portion (41) to uncurl the external curl (6) on the closure blank (5) and a second portion (45) to urge the straightened side wall of the closure blank (5) towards an inward curl.

8 Claims, 3 Drawing Sheets

METHOD FOR THE PRODUCTION OF METAL CLOSURES

TECHNICAL FIELD

The present invention relates to an improved method for manufacturing metal closures and enhanced tooling for carrying out such a method. In particular, the method is applied to the production of a metal closure from a closure shell, which has a shape adapted to reduce or eliminate the incidence of so called "angel hair".

Metal closures to which the invention is applied are made from sheet metal (for example, steel or aluminium), to which a thin polymer coating is applied. Closure shells are produced from sheets of the polymer-coated metal by stamping, which simultaneously shapes and cuts the closure blank using a co-operating punch and die. Problems have been encountered during the stamping process, because thin slivers of the polymer coating are formed where the sheet of polymer-coated metal is cut. These slivers are conventionally referred to as "angel hairs" and are visually unattractive. During later forming steps (for example, the formation of a curl at the cut metal edge) such "angel hairs" may become detached from the closure shell and form "fluff", which interferes with the forming machinery.

Conventionally, the process for production of a metal closure includes the following steps: Stamping a closure blank from a coated metal sheet in a press (having first and second parts, which move relative to one another); separating the press parts and ejecting the metal blank from one of the parts; and pre-curling the cut edge of the closure blank to form the start of an internal peripheral curl at the cut edge thereof. These steps may be carried out in the same tool or alternatively stamping and pre-curling may be carried out in separate tools. The pre-curled blank is then transferred to a curling tool, in which the cut edge of the metal shell is formed into a tight internal curl. Between the various production stages described above, the closure blank must be transported between tools by a transfer system.

BACKGROUND ART

WO 2005023451 (MAIKO ENGINEERING GMBH.). 2005 Mar. 17. proposes a metal closure blank, which has an external radius adjacent to its cut edge. This external radius has been found to prevent the formation of "angel hairs". However, at production speeds (about 1200 closures per minute), the external radius causes a number of problems with conventional tooling.

Conventional closure blanks have a cylindrical side-wall, which closely matches the side-wall of the cavity in the press and thus, the closure blank is retained in the cavity until the press parts are separated and the part carrying the closure blank reaches "top dead centre". Once this position is reached, the closure blank is ejected from the press by means of "press air". Where the closure blank has an external radius (to prevent the formation of "angel hairs"), the external radius creates a looser seat in the press cavity and interferes with press air as the press parts are separated after formation of the closure blank. Thus, the closure blank tends to twist uncontrollably and fall out of the press as the press parts are separated.

WO 200249787 (DAYTON SYSTEMS GROUP, INC.). 2002 Jun. 27. describes a press arrangement suitable for production of metal closure blanks (closure cup) having such an outward curled rim. The metal closure blank (closure cup) is biased against part of the forming punch by a first airstream introduced into the cavity within the underside of the cap. As the punch reaches "top dead centre", the blank (closure cap) is ejected from the punch by a second airstream.

A further problem is encountered during transport of the closure blanks between production stages. An air transport system is conventionally used for this purpose, in order to increase production speeds. Known air transport systems comprise a base plate, sidewalls and a top plate and an air stream passes through the volume so defined, carrying the closure blanks on a cushion of air. When closure blanks having an external radius at their cut edge are transported in such an air transport system, the air flow catches under the external radius and tends to flip or tilt the closure blanks. Thus, such closure blanks "dance" around uncontrollably in the air stream and jostle one another, damaging the thin polymer coating thereon.

U.S. Pat. No. 4,655,677 (PRECISION METAL FABRICATORS, INC.). 1987 Apr. 7. describes a similar problem, encountered when trying to transport container ends through such a conventional air conveyor system. This patent describes how stacks of container ends may be successfully transported in an air conveyer system. In this system, the top cover of the conveyor is spaced above the stack of container ends at a height which is less than the overlap of the nested container ends, thereby ensuring that the container ends remain in their respective stacks when subjected to lateral forces.

DISCLOSURE OF INVENTION

Before the closure blank passes to the curling stage of the production process, the external radius must be removed and the closure sidewall straightened before a tight inward curl may be formed on the closure shell. It has been proposed that such straightening may be most easily achieved in a further stamping operation, but this process may exacerbate the tendency of the closure blank to form an external curl.

Accordingly, the inventors propose straightening the outward radius on the closure blank by rolling the closure blank about its main axis along a tool having a flat surface parallel to the sidewall of the closure blank. Thus, the external radius on the closure blank is progressively unfurled and accidental external curling is prevented. The inventors have modified the conventional pre-curl tool to provide a straight wall portion to gently straighten the sidewall of the closure before gently urging the cut edge of the closure sidewall into an inward curl. Subsequent curling tools may then be used to tighten the inward curl, thereby creating a closure having a tight inward curl at its free peripheral edge. The flat portion of the tooling follows a gentle radius over a length greater than the external circumference of the closure shell. This ensures that the closure shell makes one complete rotation against the straightening portion of the tool and that the closure shell has a cylindrical, straight-sided configuration, before entering tooling (or portion of the tool) adapted to urge formation of an inward curl.

BRIEF DESCRIPTION OF THE DRAWINGS

The present invention will now be described, by way of example only, with reference to the accompanying drawings, in which:

Wherever possible in the drawings like reference numerals have been used to designate similar parts.

Referring to FIG. 1, a modified closure blank 1 is stamped from a sheet of steel having a thin polymer coating in a press 10 having at least two press parts 11, 12, which are capable of movement relative to each other. The closure blank 1 has a cylindrical sidewall and an external radius 6. Clamp holder 15 accommodates the external radius 6 and the press part 11 is lowered due to the reduced height of the closure blank 5. The radius of the external curl 6 and the height of the modified closure blank 5 must be optimised to ensure that "angel hair" is avoided. Such modification requires consequential modification to the press parts. For example, the "knock out" stem 16 must be lengthened/lowered to allow it to kick the closure blank 5 out of the cavity, when the press parts 11, 12 are separated and have reached the pres-defined position. Modification of the height of the modified closure blank 5 by just 0.1 mm may affect whether or not "angel hairs" are produced.

Figure 1:
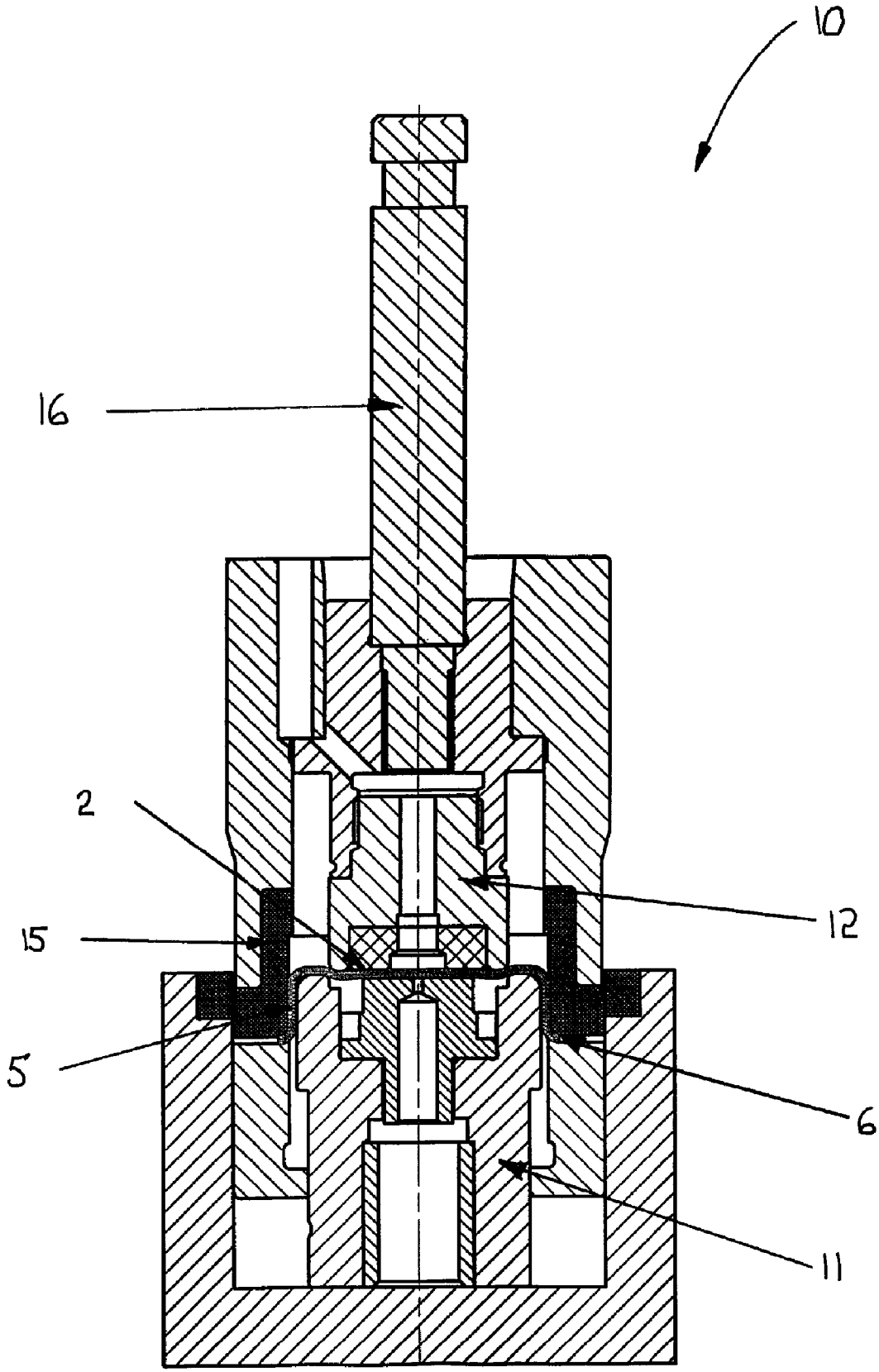
FIG. 1 shows a cross section view of a press suitable for forming a modified closure blank having an external radius at its peripheral free edge to mitigate the production of "angel hair" upon cutting.
Figure 2:
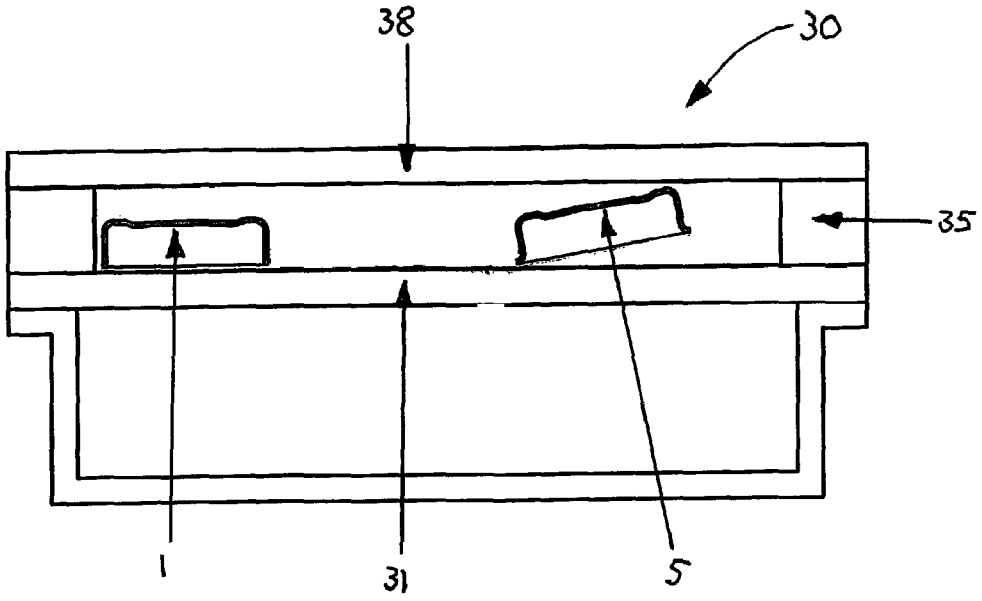
FIG. 2 shows a cross section view through a conventional air transport system with a conventional closure blank (left) and modified closure blank (right) carried therein, illustrating the tipping effect of the airflow on the external radius of the modified closure.

As illustrated diagrammatically in FIG. 2 whilst conventional closure blanks 1 are carried through an air transport system 30 on a cushion of air, the air flow interferes with the external radius on a modified closure blank 5 and tends to lift and tilt to closure blank 5, causing it to jostle amongst adjacent blanks. This affects the flow of the production process and also results in damage to the closure blanks 5.

Figure 3:
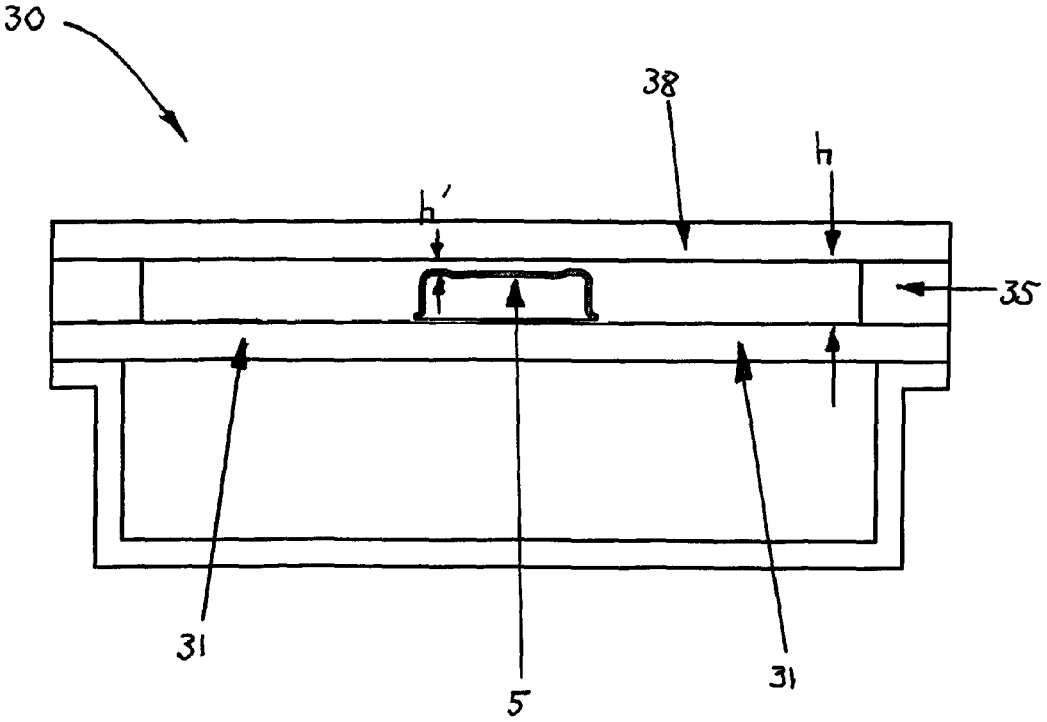
FIG. 3 shows a cross section view through a modified air transport system with a modified closure carried therein.

Referring now to FIG. 3, the transfer of modified closure blanks 5 in an air transport system 30 may be brought under control if the spacing h between the top 38 and bottom 31 of the air transport conduit is restricted. This is particularly true, if the headspace h' is less than 0.5 mm above the top of the closure blank 5.

Figure 4:
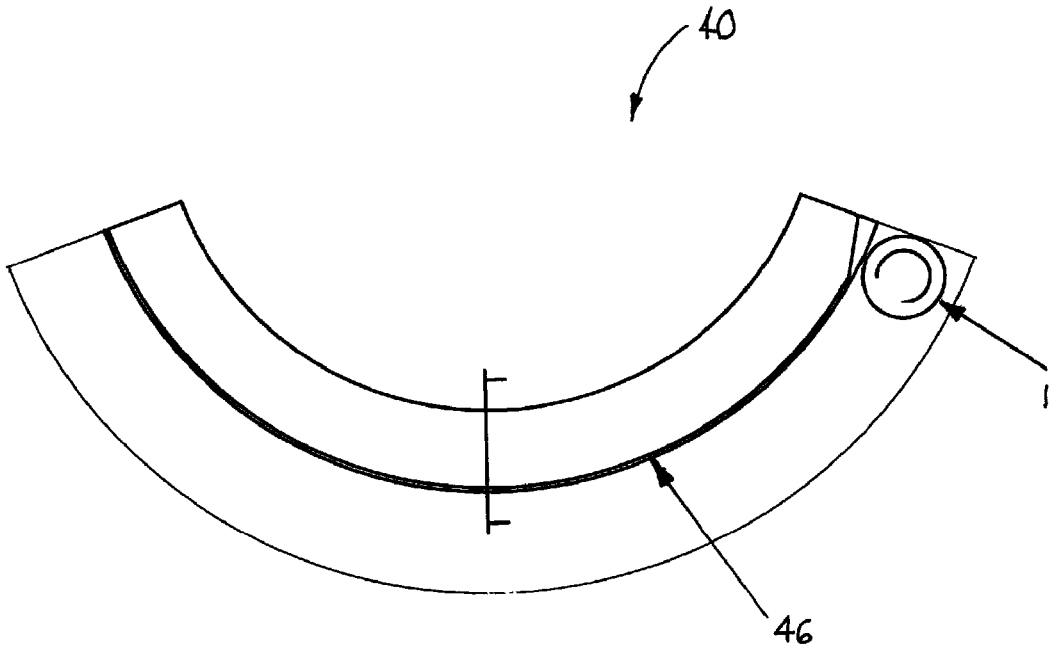
FIG. 4 shows a conventional pre-curling rail for starting the inward curl on a cylindrical wall closure blank.

Despite the disclosure in WO 200249787 (DAYTON SYSTEMS GROUP, INC.). 2002 Jun. 27. many conventional metal closures for foodstuffs have an internal curl at their peripheral edge. Thus, before an inward curl may be produced on a modified closure blank 5 (having an external radius 6) the sidewall of the closure must first be straightened. The inventors have proposed a modification to the initial segment of the pre-curling tooling 40 (shown in FIG. 4) to achieve this.

Figure 5:
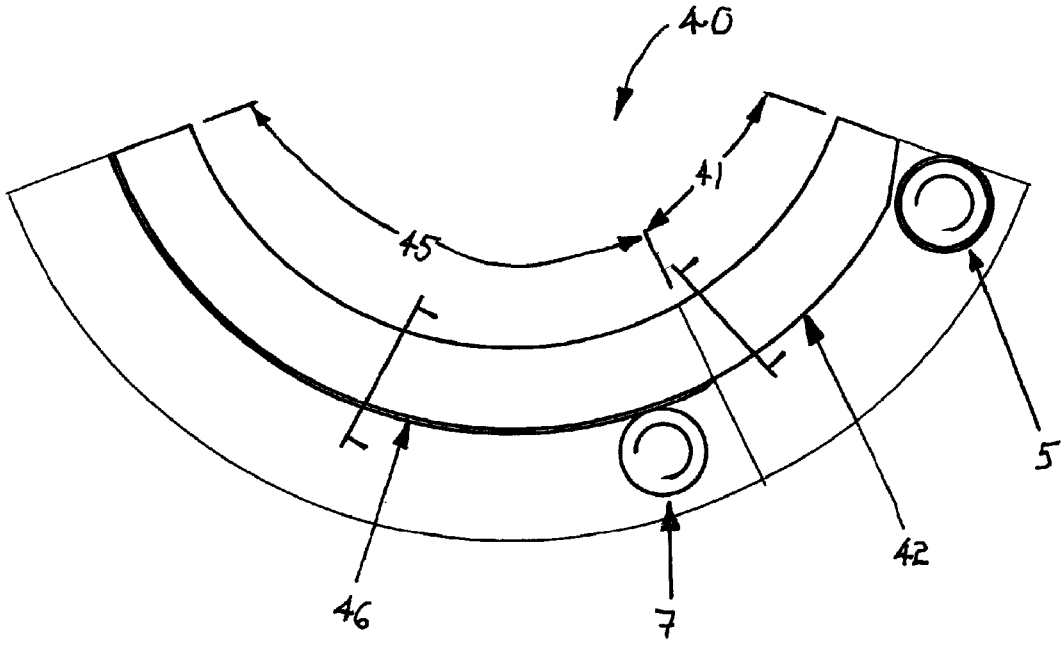
FIG. 5 shows a modified pre-curling rail having a straightening portion and a pre-curl portion for straightening the external radius on a modified closure and for forming the start of the inward curl.

Referring to FIG. 5, the pre-curling tool 40 according to the invention is divided into two portions. The first portion 41 has a straight sided wall 42, which is used to gently straighten the external curl 6 as the modified closure blank 5 is rolled against the tool. Portion 41 is of sufficient length to ensure that the closure blank 5 makes at least one complete rotation about its main axis to ensure that the side wall thereof is reformed into a straight sided cylindrical side wall. The reformed closure blank 7, then rolls against the second portion 45 of the tool, which has a pre-curling rail 46 to gently urge the cut edge of the reformed closure blank 7 towards an inward curl.

The closure blank 5 may then be transferred to the first of a series of curling tools, used to form a tight inward curl at the peripheral, cut edge of the closure shell.

The invention claimed is:

1. A method for producing metal closures without forming angel hair, the method comprising the steps of:

stamping a closure blank in a press, wherein the closure blank has a sidewall that defines an external curl;

ejecting the closure blank from the press into a chute;

transferring the closure blank from the chute to a pre-curling station; and straightening the sidewall of the closure blank by rolling it against a flat rail that is parallel to the sidewall of the closure blank to thereby unfurl the external curl, wherein the flat rail is sized to ensure that the closure blank makes at least one complete rotation about a main axis of the closure blank.

2. The method for producing metal closures according to claim 1, wherein the step of transferring the closure blank from the chute to the pre-curling station comprises using an air transport system configured to have limited headspace above the closure blank.

3. A pre-curling tool comprising:

a unitary rail defining an arc having a straightening portion defining a first arc length of the arc and configured to unfurl an external curl defined by a sidewall of a closure blank, and a pre-curl portion defining a second arc length of the arc and configured to urge a cut edge of the closure blank towards an inward curl when the closure blank is rolled against the rail, wherein the first arc length is sized to ensure that the closure blank makes at least one complete rotation about a main axis of the closure blank.

4. The method for producing metal closures according to claim 2, wherein the step of transferring the closure blank from the chute to the pre-curling station comprises using an air transport system configured to have a headspace above the closure blank that is less than 0.5 mm.

5. The method for producing metal closures according to claim 1, further comprising urging a cut edge of the closure blank towards an inward curl.

6. The method for producing metal closures according to claim 5, wherein the urging step comprises urging the cut edge against a pre-curling rail to form the inward curl.

7. The method for producing metal closures according to claim 6, wherein the steps of straightening the sidewall of the closure blank and urging the cut edge of the closure blank towards an inward curl are performed using a unitary pre-curling tool.

8. The pre-curling tool according to claim 3, wherein the straightening portion is parallel to the sidewall of the closure blank.

* * * * *